US008640821B2

(12) United States Patent
Matsushima et al.

(10) Patent No.: US 8,640,821 B2
(45) Date of Patent: Feb. 4, 2014

(54) EXHAUST SYSTEM OF ENGINE

(71) Applicant: Honda Motor Co., Ltd., Tokyo (JP)

(72) Inventors: Satoshi Matsushima, Wako (JP); Tatsuya Sasaki, Wako (JP); Seiichiro Eguchi, Wako (JP); Hirotsugu Ishizaki, Wako (JP); Yoshitaka Hayama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/718,890

(22) Filed: Dec. 18, 2012

(65) Prior Publication Data

US 2013/0180798 A1 Jul. 18, 2013

(30) Foreign Application Priority Data

Jan. 18, 2012 (JP) ..... 2012-008079
Aug. 7, 2012 (JP) ..... 2012-175125

(51) Int. Cl.

| | |
|---|---|
| ***F01N 1/08*** | (2006.01) |
| ***F01N 1/10*** | (2006.01) |
| ***F01N 13/08*** | (2010.01) |
| *F01N 1/00* | (2006.01) |
| *F01N 13/00* | (2010.01) |

(52) U.S. Cl.
USPC ..... 181/252; 181/256; 181/227; 181/228

(58) Field of Classification Search
USPC ..... 181/252, 256, 249, 255, 227, 228, 248, 181/251, 257, 274, 275, 279
See application file for complete search history.

(56) References Cited

U.S. PATENT DOCUMENTS

| | | | | | |
|---|---|---|---|---|---|
| 1,070,600 | A | * | 8/1913 | Haugen | 181/268 |
| 1,993,397 | A | * | 3/1935 | Berg et al. | 181/248 |
| 2,213,614 | A | * | 9/1940 | Scarritt | 181/255 |
| 2,529,136 | A | * | 11/1950 | Carlson | 181/255 |
| 3,561,562 | A | * | 2/1971 | Ignoffo | 181/247 |
| 3,858,678 | A | * | 1/1975 | Haren | 181/227 |
| 3,863,733 | A | * | 2/1975 | Raudman et al. | 181/252 |
| 4,184,565 | A | * | 1/1980 | Price et al. | 181/252 |
| 4,234,054 | A | * | 11/1980 | Chapin | 181/252 |
| 4,325,459 | A | * | 4/1982 | Martin | 181/248 |
| 4,333,544 | A | * | 6/1982 | Seeger | 181/266 |

(Continued)

FOREIGN PATENT DOCUMENTS

| | | | | | |
|---|---|---|---|---|---|
| JP | 58008215 | A | * | 1/1983 | F01N 1/10 |
| JP | 2010-216340 | A | | 9/2010 | |
| JP | 2012035714 | A | * | 2/2012 | |
| JP | 2012167596 | A | * | 9/2012 | |

*Primary Examiner* — Edgardo San Martin
(74) *Attorney, Agent, or Firm* — Birch, Stewart, Kolasch & Birch, LLP

(57) ABSTRACT

An exhaust system for an engine includes an exhaust pipe connected to an exhaust port of an engine and a muffler attached to the exhaust pipe and configured to reduce exhaust noise. The muffler includes an inner cylinder part connected to the downstream end of the exhaust pipe, an outer cylinder part configured to cover an outside of the inner cylinder part and noise absorbing materials disposed between the inner cylinder part and the outer cylinder part. A plurality of first communication holes providing communication between an inside and an outside of the inner cylinder part is formed in an upstream portion of the inner cylinder part. A plurality of second communication holes providing communication between the inside and the outside of the inner cylinder part is formed in a downstream portion of the inner cylinder part. Guide walls extend toward the inside of the inner cylinder part.

17 Claims, 12 Drawing Sheets

(56) References Cited

U.S. PATENT DOCUMENTS

| | | | | | |
|---|---|---|---|---|---|
| 4,487,290 | A * | 12/1984 | Flaherty | 181/256 |
| 4,842,096 | A * | 6/1989 | Fujitsubo | 181/252 |
| 5,183,976 | A * | 2/1993 | Plemons, Jr. | 181/264 |
| 5,659,158 | A * | 8/1997 | Browning et al. | 181/268 |
| 5,831,223 | A * | 11/1998 | Kesselring | 181/227 |
| 5,902,970 | A * | 5/1999 | Ferri | 181/249 |
| 6,026,930 | A * | 2/2000 | Ogisu et al. | 181/228 |
| 6,116,377 | A * | 9/2000 | Dugan | 181/272 |
| 6,443,255 | B1 * | 9/2002 | Shavender, Jr. | 181/250 |
| 6,550,572 | B2 * | 4/2003 | Lin | 181/252 |
| 6,598,390 | B2 * | 7/2003 | Chang | 60/323 |
| 6,679,351 | B2 * | 1/2004 | Cummings et al. | 181/212 |
| 6,840,348 | B2 * | 1/2005 | Takewaka et al. | 181/252 |
| 6,857,502 | B2 * | 2/2005 | Naito | 181/252 |
| 7,424,931 | B2 * | 9/2008 | Smith | 181/256 |
| 7,434,656 | B2 * | 10/2008 | Yasuda et al. | 181/227 |
| 7,552,797 | B2 * | 6/2009 | Luttig | 181/250 |
| 7,624,842 | B2 * | 12/2009 | Mizutani | 181/249 |
| 7,779,963 | B2 * | 8/2010 | Muto | 181/252 |
| 7,810,609 | B2 * | 10/2010 | Sikes et al. | 181/250 |
| 7,895,832 | B2 * | 3/2011 | Gruber | 60/299 |
| 8,083,025 | B2 * | 12/2011 | Murakami et al. | 181/249 |
| 8,104,571 | B2 * | 1/2012 | Nakajima | 181/252 |
| 8,292,017 | B2 * | 10/2012 | Inoue et al. | 180/219 |
| 2002/0134614 | A1 * | 9/2002 | Chen | 181/252 |
| 2004/0163886 | A1 * | 8/2004 | Sutera et al. | 181/255 |
| 2007/0095605 | A1 * | 5/2007 | You | 181/256 |
| 2007/0289809 | A1 * | 12/2007 | Kim | 181/227 |
| 2010/0230204 | A1 | 9/2010 | Inoue et al. | |
| 2011/0048849 | A1 * | 3/2011 | Nakajima | 181/252 |
| 2012/0031698 | A1 * | 2/2012 | Inoue et al. | 181/252 |
| 2012/0205191 | A1 * | 8/2012 | Matsushima et al. | 181/227 |
| 2012/0261210 | A1 * | 10/2012 | Kondou | 181/228 |
| 2013/0112498 | A1 * | 5/2013 | Maejima et al. | 181/228 |

* cited by examiner

EXHAUST SYSTEM OF ENGINE

CROSS-REFERENCE TO RELATED APPLICATIONS

The present application claims priority under 35 USC 119 to Japanese Patent Application No. 2012-008079 filed Jan. 18, 2012 and Japanese Patent Application No. 2012-175125 filed Aug. 7, 2012 the entire contents of which are hereby incorporated by reference.

BACKGROUND OF THE INVENTION

1. Field of the Invention

The present invention relates to an exhaust system of an engine.

2. Description of Background Art

An exhaust system of an engine includes an inner pipe provided with a plurality of vent holes connected to an exhaust pipe at an upstream end portion, an outer pipe configured to surround the inner pipe by forming an annular chamber between the inner pipe and the outer pipe and glass wool that is a noise absorbing material filled in the annular chamber, to reduce exhaust noise has been known in the related art. See, for example, JP-A No. 2010-216340.

The exhaust system of the engine described in JP-A No. 2010-216340 is able to reduce exhaust noise, but fails to improve the output of the engine.

SUMMARY AND OBJECTS OF THE INVENTION

The present invention has been made to consider the aforementioned situation, and an object of an embodiment of the present invention is to provide an exhaust system for an engine capable of reducing exhaust noise and improving an output of the engine.

In order to achieve the object, according to an embodiment of the present invention, there is provided an exhaust system for an engine including an exhaust pipe connected to an exhaust port of the engine and a muffler attached to a downstream end of the exhaust pipe and configured to reduce exhaust noise. The muffler includes an inner cylinder part connected to the downstream end of the exhaust pipe, an outer cylinder part configured to cover an outside of the inner cylinder part, and noise absorbing material disposed between the inner cylinder part and the outer cylinder part. A plurality of first communication holes to provide communication between an inside and an outside of the inner cylinder part is formed in an upstream portion of the inner cylinder part. A plurality of second communication holes to provide communication between the inside and the outside of the inner cylinder part is formed in a downstream portion of the inner cylinder part. The plurality of first communication holes includes a guide wall extending toward the inside of the inner cylinder part and an inlet opening formed by the guide wall and opened toward an upstream side of exhaust.

According to an embodiment of the present invention, the inner cylinder part is formed so that a diameter thereof decreases along a downstream side of the exhaust.

According to an embodiment of the present invention, the plurality of first communication holes and the plurality of second communication holes are formed by press molding a metal plate. The inner cylinder part is formed by rolling up and forming the metal plate into a cylinder shape so that the guide wall of each first communication hole becomes an inner side.

According to an embodiment of the present invention, the noise absorbing material includes a first noise absorbing material configured to cover an outer peripheral surface of the inner cylinder part, and a second noise absorbing material configured to cover an outer peripheral surface of the first noise absorbing material. The first noise absorbing material has higher heat resistance than that of the second noise absorbing material.

According to an embodiment of the present invention, the plurality of first communication holes and the plurality of second communication holes are formed by press molding the metal plate. The inner cylinder part is formed by rolling up and forming the metal plate into a cylinder shape so that the guide wall of the first communication hole becomes the inner side. The noise absorbing material includes the first noise absorbing material configured to cover the outer peripheral surface of the inner cylinder part. The second noise absorbing material is configured to cover the outer peripheral surface of the first noise absorbing material. The first noise absorbing material has higher heat resistance than that of the second noise absorbing material.

According to an embodiment of the present invention, a third communication hole having a larger opening area than that of the second communication hole is further formed in a portion of the exhaust pipe upstream the inner cylinder part. An outer peripheral surface of the exhaust pipe is formed at a position with the third communication hole and is covered by a noise absorbing material.

According to an embodiment of the present invention, the plurality of first communication holes is disposed in a zigzag shape so that the inlet opening of each first communication hole on an upstream side and an inlet opening of each first communication hole on a downstream side do not overlap along a flow of exhaust.

According to an embodiment of the present invention, the plurality of second communication holes includes a guide wall extending toward the outside of the inner cylinder part and an inlet opening formed by the guide wall and opened toward the upstream side of the exhaust.

According to an embodiment of the present invention, a downstream side portion of the exhaust pipe is branched into two portions, and the muffler is attached to each of downstream ends of two branched exhaust pipes.

According to an embodiment of the present invention, the plurality of first communication holes and the plurality of second communication holes are formed on the upstream side of the inner cylinder part rather than the downstream end thereof.

According to an embodiment of the present invention, a partition plate is provided on an outer peripheral surface at a downstream end of the inner cylinder part, and the noise absorbing material is positioned by the partition plate.

According to an embodiment of the present invention, a plurality of first communication holes providing communication between an inside and an outside of an inner cylinder part is formed in an upstream portion of the inner cylinder part. A plurality of second communication holes providing communication between the inside and the outside of the inner cylinder part is formed in a downstream portion of the inner cylinder part. The plurality of first communication holes includes guide walls extending toward the inside of the inner cylinder part and inlet openings formed by the guide walls and opened toward an upstream side of exhaust wherein a pressure wave of exhaust gas absorbed to the noise absorbing materials outside the inner cylinder part can be improved by the guide walls of the first communication holes of the upstream portion. Thus, pressure increased by the pressure wave of the exhaust gas can be returned inside the inner cylinder part and the pressure can be reduced, by the second communication holes of the downstream portion. Accordingly, the exhaust noise can be reduced and an output of the engine can be improved.

According to an embodiment of the present invention, since the inner cylinder part is formed so that the diameter thereof decreases along the downstream side of the exhaust, the effect of making the pressure wave of the exhaust gas absorbed to the noise absorbing materials outside the inner cylinder part can be further improved during the high-rate revolution.

According to an embodiment of the present invention, since the plurality of first communication holes and the plurality of second communication holes are formed by press molding a metal plate, and the inner cylinder part is formed by rolling up and forming the metal plate in a cylinder shape so that the guide wall of the first communication hole becomes an inner side, it is easy to manufacture the inner cylinder part. Thus, productivity of the muffler can be improved, and manufacturing cost can be reduced.

According to an embodiment of the present invention, since the noise absorbing materials include a first noise absorbing material configured to cover an outer peripheral surface of the inner cylinder part, and a second noise absorbing material configured to cover an outer peripheral surface of the first noise absorbing material, and the first noise absorbing material has higher heat resistance than that of the second noise absorbing material, durability of the second noise absorbing material against high-temperature and high-pressure exhaust gas discharged from the inner cylinder part can be maintained by the guide walls while maintaining the large opening areas of the plurality of first communication holes and improving a muffling effect.

According to an embodiment of the present invention, since the plurality of first communication holes and the plurality of second communication holes are formed by press molding the metal plate, and the inner cylinder part is formed by rolling up and forming the metal plate into a cylinder shape so that the guide wall of the first communication hole becomes an inner side, it is easy to manufacture the inner cylinder part. Thus, productivity of the muffler can be improved, and manufacturing costs can be reduced. Further, since the noise absorbing materials include the first noise absorbing material configured to cover the outer peripheral surface of the inner cylinder part, and the second noise absorbing material configured to cover the outer peripheral surface of the first noise absorbing material, and the first noise absorbing material has higher heat resistance than that of the second noise absorbing material. Thus, the durability of the noise absorbing material against the high-temperature and high-pressure exhaust gas discharged from the inner cylinder part can be maintained by the guide walls while maintaining the large opening areas of the plurality of first communication holes and improving the muffling effect.

According to an embodiment of the present invention, since third communication holes having a larger opening area than that of the second communication hole are further formed in a portion of the exhaust pipe upstream the inner cylinder part, and an outer peripheral surface of the exhaust pipe at a position with the third communication holes formed is covered by a third noise absorbing material, exhaust noise can be further reduced.

According to an embodiment of the present invention, since the plurality of first communication holes is disposed in a zigzag shape so that an inlet opening of each first communication hole on an upstream side and an inlet opening of each first communication hole on a downstream side do not overlap along the flow of the exhaust, the effect of making the pressure wave of the exhaust gas be absorbed to the noise absorbing materials outside the inner cylinder part can be further improved, and the exhaust noise can be further reduced.

According to an embodiment of the present invention, since the plurality of second communication holes includes guide walls extending toward the outside of the inner cylinder part and inlet openings formed by the guide walls and opened toward the upstream side of the exhaust, the pressure wave of the exhaust gas introduced to the outside of the inner cylinder part can be positively returned inside the inner cylinder part and the muffling effect by the noise absorbing materials can be further improved.

According to an embodiment of the present invention, since a downstream side portion of the exhaust pipe is branched into two portions, and the muffler is attached to each of downstream ends of two branched exhaust pipes, by providing two mufflers, the exhaust gas flowing through a more central portion of the inner cylinder part can be introduced while decreasing a guide height. Thus, productivity of the inner cylinder part can be improved while improving the muffling effect.

According to an embodiment of the present invention, since the plurality of first communication holes and the plurality of second communication holes are formed on the upstream side of the inner cylinder part rather than the downstream end thereof, a long tail pipe on the downstream side of the inner cylinder part can remain without increasing a size of the muffler. Accordingly, exhaust inertia becomes good, so that the muffling effect can be improved while improving engine performance.

According to an embodiment of the present invention, since a partition plate is provided on an outer peripheral surface at an downstream end of the inner cylinder part, and the noise absorbing materials are positioned by the partition plate, movement of the noise absorbing materials by the exhaust gas introduced to the outside of the inner cylinder part can be prevented, and the muffling effect can be improved for a long time.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
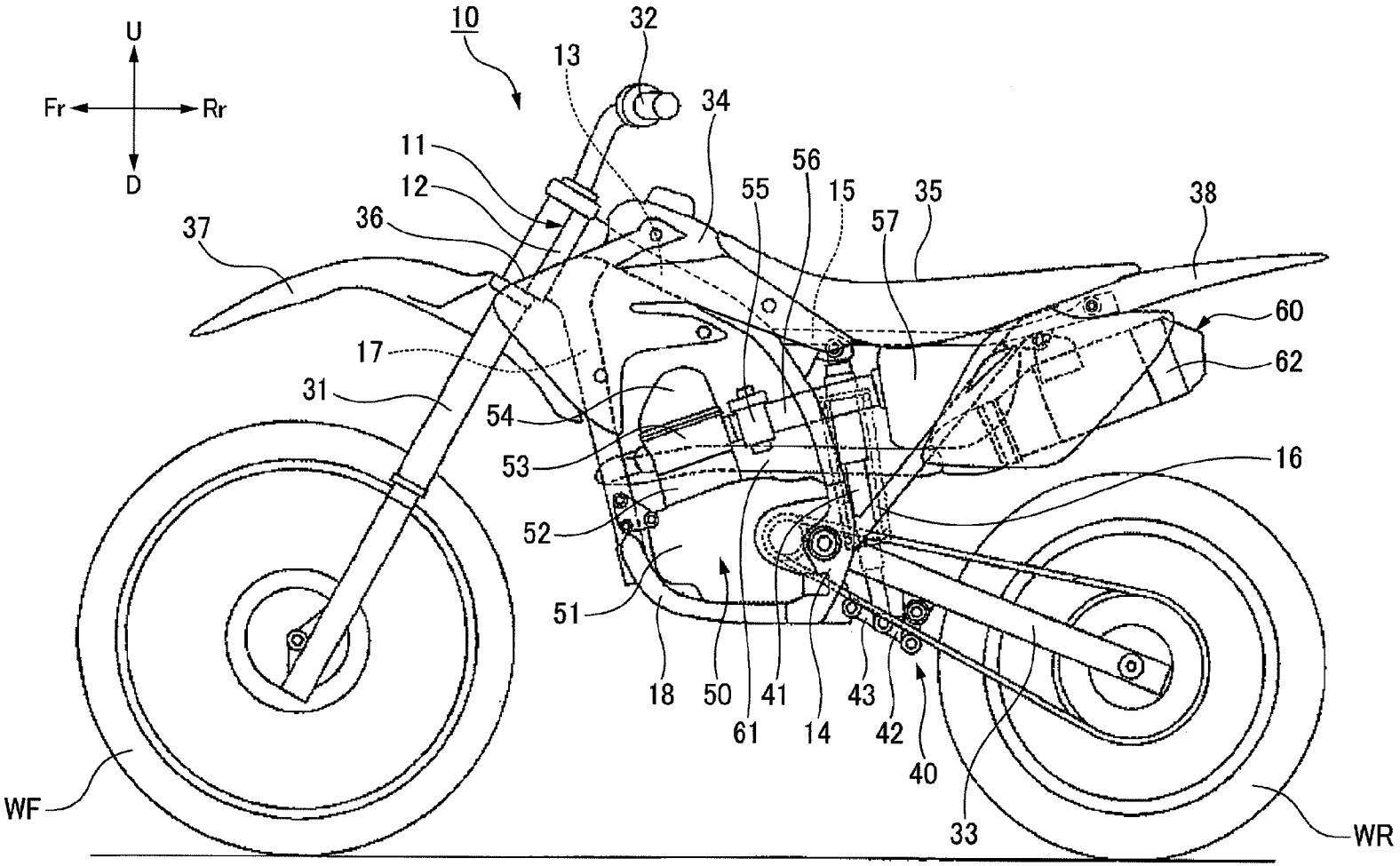
FIG. 1 is a left side view describing a motorcycle on which an embodiment of an exhaust system of an engine according to the present invention is mounted.

Hereinafter, an embodiment of an exhaust system of an engine according to the present invention will be described in detail with reference to the drawings. Note that the drawings are viewed based on the reference numerals, and in the following description, directions, such as front and rear, left and right, and up and down are based on a direction of a rider's view. In addition, Fr indicates a front side of a vehicle, Rr indicates a rear side of the vehicle, L indicates a left side of the vehicle, R indicates a right side of the vehicle, U indicates an upper side of the vehicle, and D indicates a lower side of the vehicle.

Figure 2:
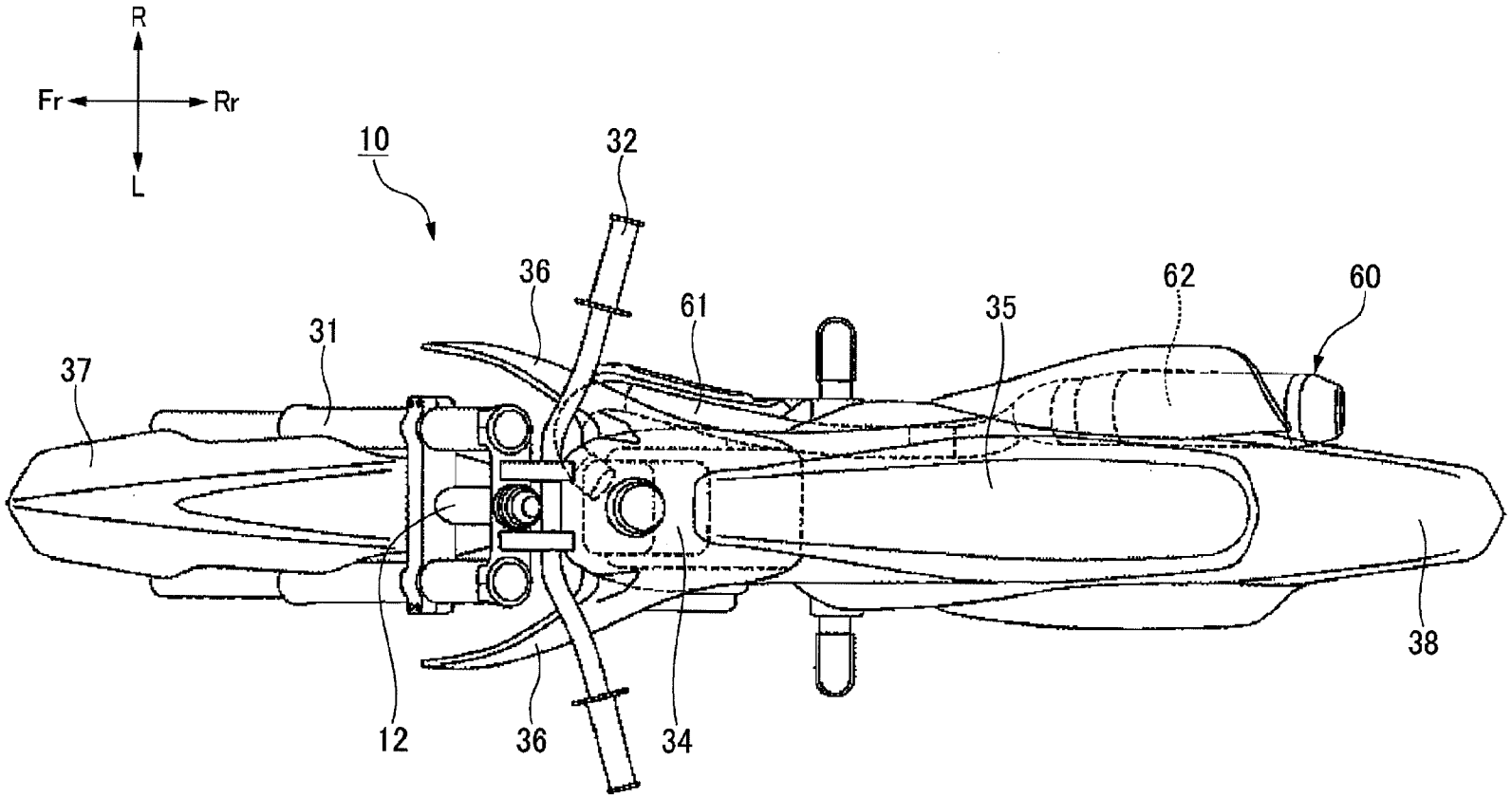
FIG. 2 is a top view of the motorcycle illustrated in FIG. 1.

A motorcycle 10 of the present embodiment includes, as illustrated in FIGS. 1 and 2, a vehicle body frame 11 composed of a head pipe 12 provided at a front end, a pair of left and right main frames 13 divided from the head pipe 12 to left and right sides and extending rearwardly and downward, a pair of left and right pivot frames 14 connected to rear end portions of the pair of left and right main frames 13 and extending downward. A pair of left and right seat frames 15 is connected to central portions of the pair of left and right main frames 13 and extend rearwardly. A pair of left and right sub-frames 16 is connected to central portions of the pair of left and right pivot frames 14 and extending rearwardly and upwardly. A down frame 17 extends downwardly from the head pipe 12 with a pair of left and right bottom frames 18 connecting a lower end portion of the down frame 17 and lower end portions of the pair of left and right pivot frames 14. An engine 50 is attached to the pivot frames 14 and the bottom frames 18.

Further, the motorcycle 10 includes a front fork 31 steerably supported to the head pipe 12, a front wheel WF rotatably supported to a lower end portion of the front fork 31, a steering handlebar 32 attached to an upper end portion of the front fork 31, a swing arm 33 swingably supported to the pivot frame 14, a rear wheel WR rotatably supported to a rear end portion of the swing arm 33, a rear wheel suspension apparatus 40 configured to suspend the swing arm 33 to the seat frame 15, a fuel tank 34 attached to the main frames 13, and an occupant seat 35 attached to the seat frames 15. Note that FIG. 1 illustrates a shroud 36, a front fender 37, and a rear fender 38.

The rear wheel suspension apparatus 40 includes, as illustrated in FIG. 1, a buffer 41 of which an upper end portion is swingably attached to the seat frame 15, a substantially triangular first link 42 configured to swingably connect a lower end portion of the buffer 41 and a lower surface of the swing arm 33, and a second link 43 configured to swingably connect the first link 42 and a lower end portion of the pivot frame 14.

An outer shell of the engine 50 mainly includes, as illustrated in FIG. 1, a crankcase 51, a cylinder block 52 attached to a front upper end portion of the crankcase 51, a cylinder head 53 attached to an upper end portion of the cylinder block 52, and a cylinder head cover 54 configured to cover an upper opening of the cylinder head 53.

Further, a throttle body 55, a connecting tube 56, and an air cleaner case 57 are sequentially connected to a rear surface of the cylinder head 53. Further, an exhaust system 60 of the present embodiment is connected to a front surface of the cylinder head 53.

The exhaust system 60 includes, as illustrated in FIGS. 1 and 2, an exhaust pipe 61 connected to an exhaust port not illustrated of the cylinder head 53 and extending to a right side of the vehicle and then extending rearwardly, and a muffler 62 attached to a downstream end of the exhaust pipe 61 and configured to reduce exhaust noise.

Figure 3:
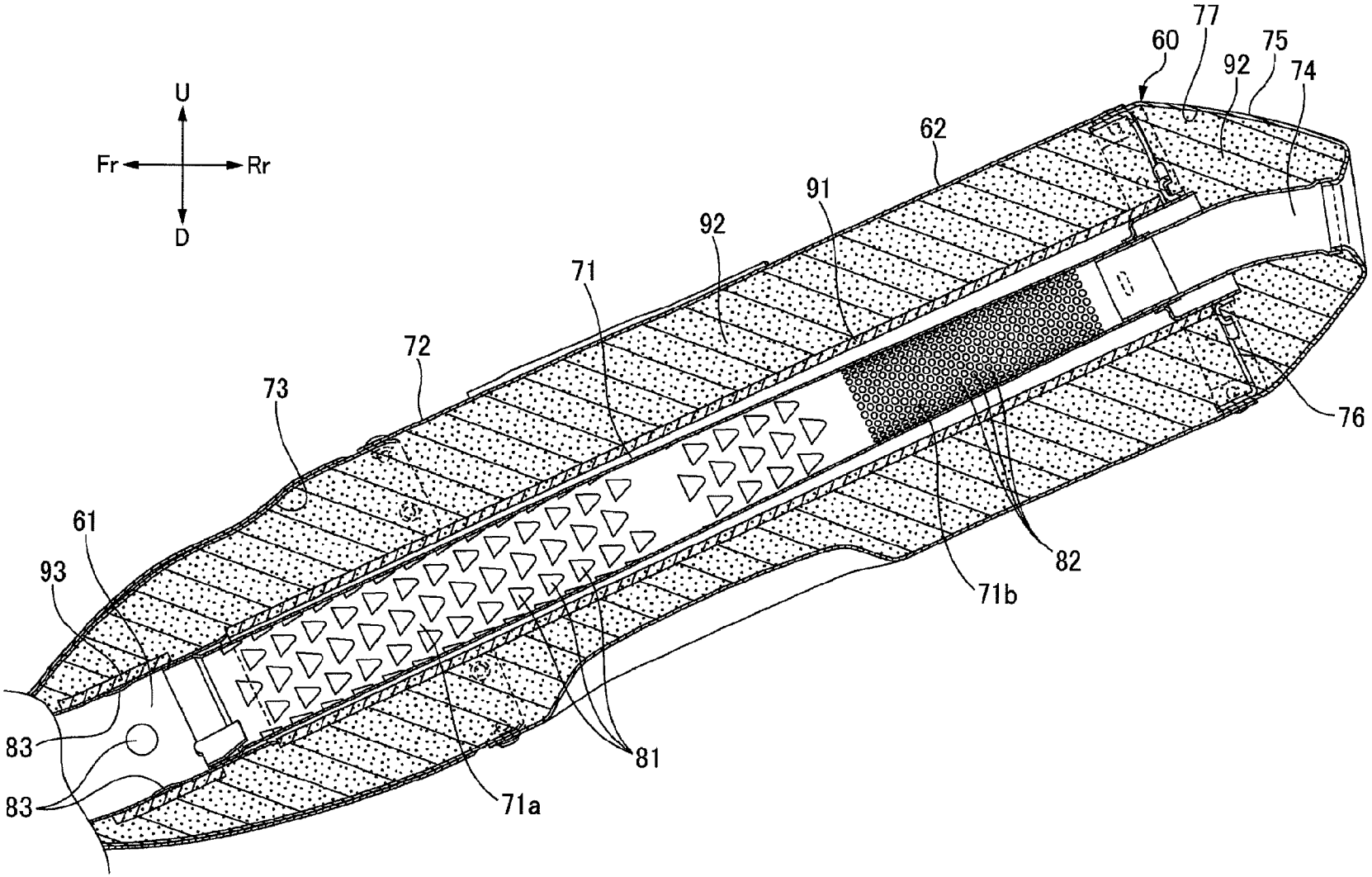
FIG. 3 is a vertical cross-sectional view of a muffler illustrated in FIG. 1.

The muffler 62 includes, as illustrated in FIG. 3, an inner cylinder part 71 connected to the downstream end of the exhaust pipe 61, an outer cylinder part 72 configured to cover an outside of the inner cylinder part 71 while forming an annular chamber 73 between the inner cylinder part 71 and the outer cylinder part, a tail pipe 74 connected to a downstream end of the inner cylinder part 71, an end cap 75 attached to a rear end portion of the outer cylinder part 72, a partition plate 76 attached to an inside of the end cap 75, a first noise absorbing material 91 configured to cover an outer peripheral surface of the inner cylinder part 71, a second noise absorbing material 92 configured to cover an outer peripheral surface of the first noise absorbing material 91, and a third noise absorbing material 93 configured to cover an outer peripheral surface of the exhaust pipe 61 inside the muffler 62. Further, a rear annular chamber 77 communicating with the annular chamber 73 is formed between the tail pipe 74 and the end cap 75. The rear annular chamber 73 is filled with the second noise absorbing material 92.

Further, the first noise absorbing material 91 and the third noise absorbing material 93 are made of a steel wool, and the second noise absorbing material 92 is made of a glass wool. Accordingly, the first noise absorbing material 91 and the third noise absorbing material 93 have higher heat resistance than that of the second noise absorbing material 92.

Further, a plurality of first communication holes 81 providing communication between the inside and outside the inner cylinder part 71 is formed in an upstream portion 71*a* of the inner cylinder part 71, and a plurality of second communication holes 82 providing communication between inside and outside the inner cylinder part 71 is formed in a downstream portion 71*b* of the inner cylinder part 71.

Figure 4:
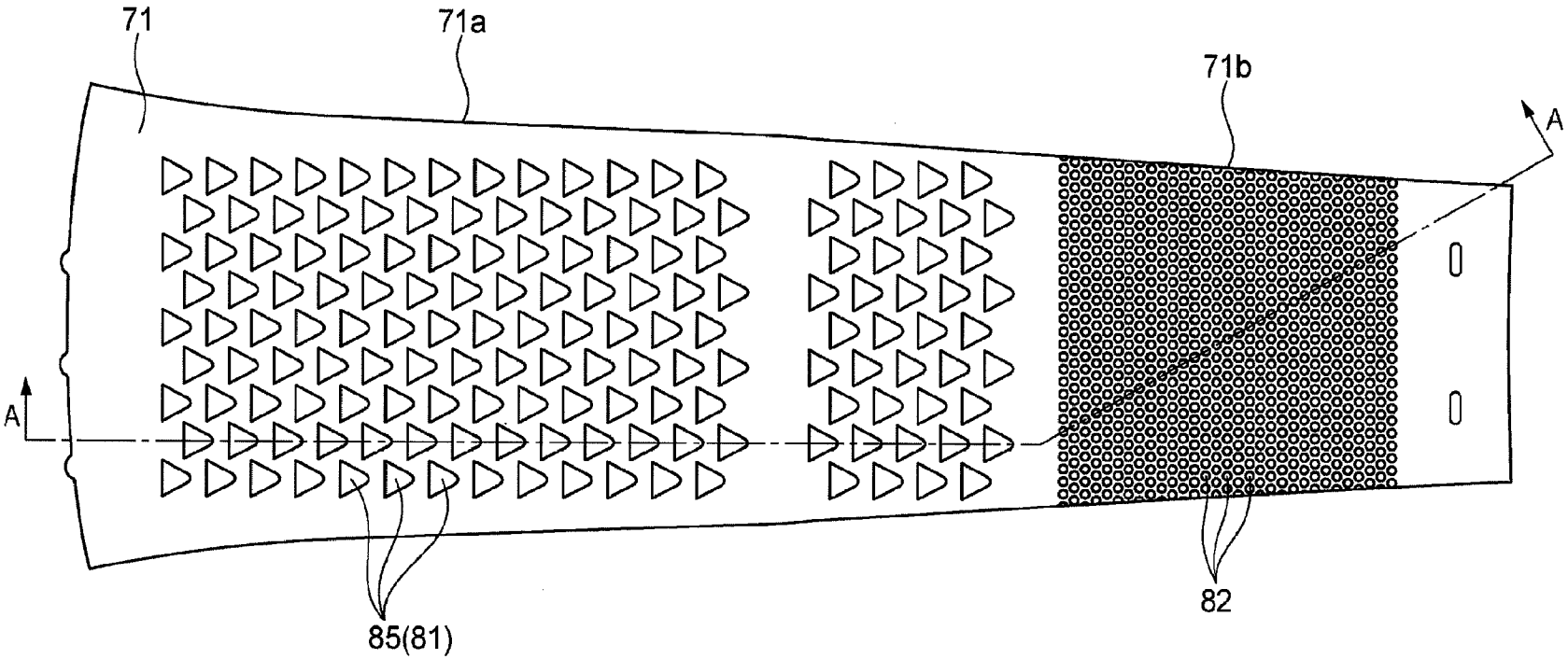
FIG. 4 is a development diagram representing an inner cylinder part illustrated in FIG. 3.
Figure 5:
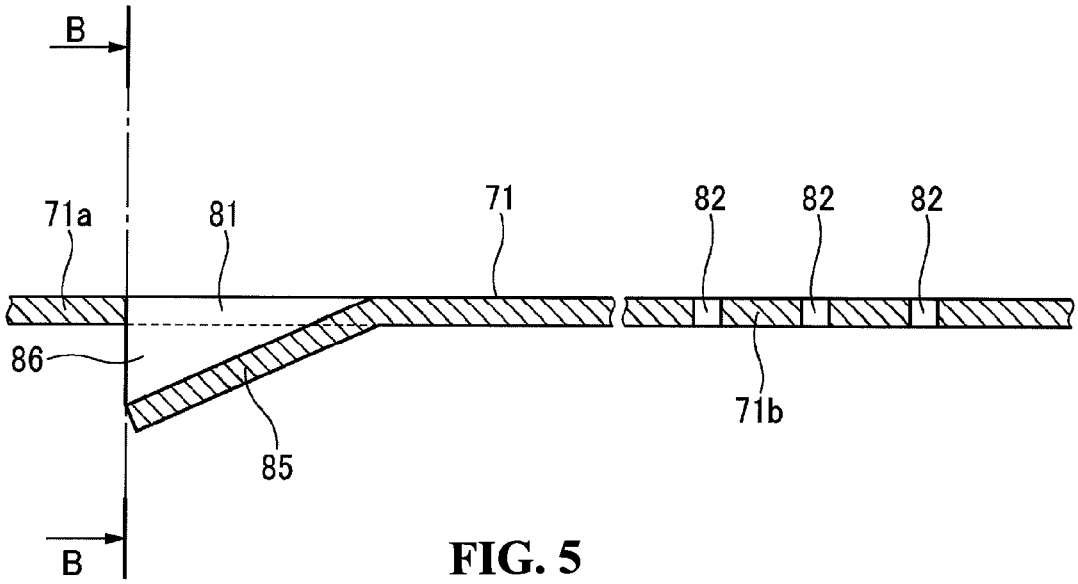
FIG. 5 is a cross-sectional view taken along line A-A of FIG. 4.
Figure 6:
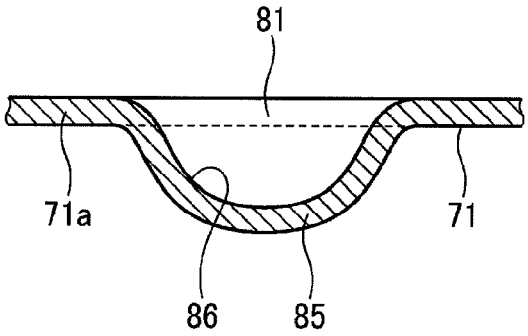
FIG. 6 is a cross-sectional view taken along line B-B of FIG. 5.

As illustrated in FIGS. 4 to 6, each first communication hole 81 is formed into a triangle and a top point thereof is disposed so as to face a downstream side of the exhaust when viewed from a radial direction of the inner cylinder part 71. Further, the first communication holes 81 include guide walls 85 extending toward the inside of the inner cylinder part 71 and inlet openings 86 formed by the guide walls 85 and opened toward an upstream side of the exhaust. Each guide wall 85 is formed in a shape like a cone shape vertically cut in half. Accordingly, the inlet opening 86 forms a semicircular opening. Further, the plurality of first communication holes 81 is disposed in a zigzag shape so that the inlet opening 86 in an upstream side and the inlet opening 86 in a downstream side do not overlap along the flow of the exhaust.

As illustrated in FIG. 4, the second communication holes 82 are formed into a circle and disposed in a zigzag shape like the first communication holes 81 when viewed from the radial direction of the inner cylinder part 71.

Further, as illustrated in FIG. 3, third communication holes 83 having a larger opening area than that of the second communication hole 82 are formed in a portion (the downstream end of the exhaust pipe 61) of the inner cylinder part 71 upstream the exhaust pipe 61. The third communication hole 83 has a circle shape, and the four third communication holes 83 are formed in a circumferential direction of the exhaust pipe 61 at a phase of 90 degrees. Further, the outer peripheral surface of the exhaust pipe 61 at a position with the third communication holes 83 formed is covered by the third noise absorbing material 93 made of the steel wool.

Further, the inner cylinder part 71 is formed by rolling up and forming a metal plate with the plurality of first communication holes 81 and the plurality of second communication holes 82 press molded, into a cylinder shape so that the guide wall 85 of the first communication hole 81 becomes the inner side. Further, the inner cylinder part 71 is formed so that a diameter thereof decreases along the downstream side of the exhaust.

As described above, according to the exhaust system 60 of the engine 50 of the present embodiment, since the plurality of first communication holes 81 is formed on the upstream portion 71*a* of the inner cylinder part 71, the plurality of second communication holes 82 is formed in the downstream portion 71*b* of the inner cylinder part 71, and the first communication holes 81 includes the guide walls 85 extending toward the inside of the inner cylinder part 71 and the inlet openings 86 formed by the guide walls 85 and opened toward the upstream side of the exhaust. Thus, an absorbing of a pressure wave of exhaust gas by the first and second noise absorbing materials 91 and 92 outside the inner cylinder part 71 can be improved by the guide walls 85 of the first communication holes 81 of the upstream portion 71*a*, and pressure increased by the pressure wave of the exhaust gas can be returned into the inner cylinder part 71 and the pressure can be reduced, by the second communication holes 82 of the downstream portion 71*b*. Accordingly, the exhaust noise can be reduced and the output of the engine 50 can be improved.

Further, according to the exhaust system 60 of the engine 50 of the present embodiment, since the inner cylinder part 71 is formed so that the diameter thereof decreases along the downstream side of the exhaust. Thus, the pressure wave of the exhaust gas can be absorbed by the first and second noise absorbing materials 91 and 92 outside the inner cylinder part 71 and can be further improved during a high-rate of revolution.

Further, according to the exhaust system 60 of the engine 50 of the present embodiment, since the inner cylinder part 71 is formed by rolling up and forming the metal plate with the first plurality of communication holes 81 and the plurality of second communication holes 82 press molded, into a cylinder shape so that the guide walls 85 of the first communication holes 81 become the inner side, it is easy to manufacture the inner cylinder part 71. Thus, productivity of the muffler 62 can be improved, and manufacturing costs can be reduced.

Further, according to the exhaust system 60 of the engine 50 of the present embodiment, since the first noise absorbing material 91 has higher heat resistance than that of the second noise absorbing material 92, durability of the second noise absorbing material 92 against high-temperature and high-pressure exhaust gas discharged from the inner cylinder part 71 can be maintained by the guide walls 85 while maintaining the large opening areas of the plurality of first communication holes 81 and improving a muffling effect.

Further, according to the exhaust system 60 of the engine 50 of the present embodiment, since the third communication holes 83 having the larger opening areas than those of the second communication holes 82 are further formed in the part of the exhaust pipe 61 upstream the inner cylinder part 71 and the outer peripheral surface of the exhaust pipe 61 at a position with the third communication holes 83 is covered by the third noise absorbing material 93. Thus, the exhaust noise can be further reduced.

Further, according to the exhaust system 60 of the engine 50 of the present embodiment, since the plurality of first communication holes 81 is disposed in a zigzag shape so that the inlet opening 86 on the upstream side and the inlet opening 86 on the downstream side do not overlap along the flow of the exhaust, the pressure wave of the exhaust gas can further improved to be absorbed to the first and second noise absorbing materials 91 and 92 outside the inner cylinder part 71. Thus, the exhaust noise may be further reduced.

Figure 7:
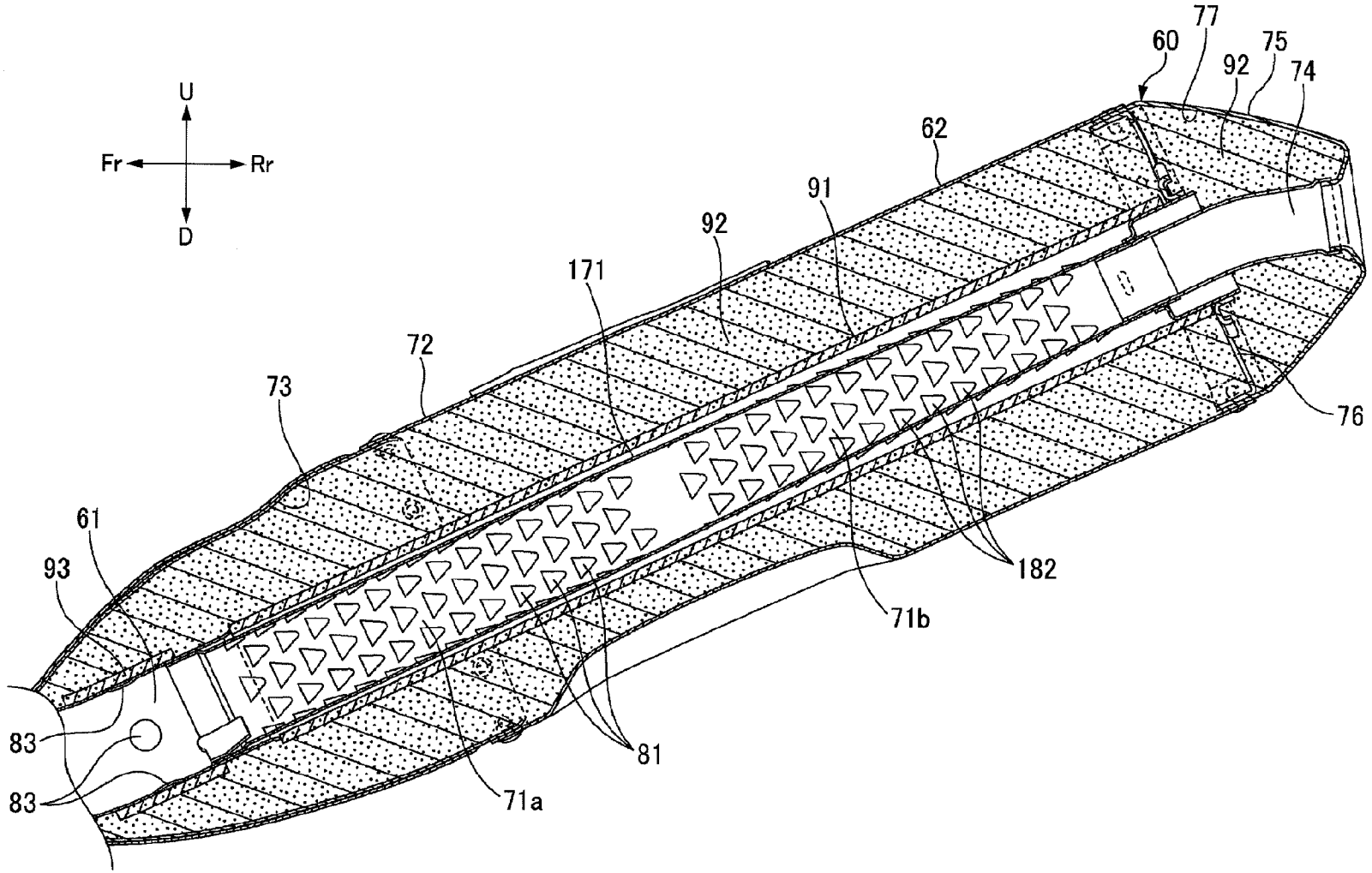
FIG. 7 is a vertical cross-sectional view corresponding to FIG. 3 which describes a modified example of a muffler.

Further, as a modified example of the muffler 62 of the present embodiment, as illustrated in FIG. 7, an inner cylinder part 171 may be used instead of the inner cylinder part 71. Further, second communication holes 182 are formed in the inner cylinder part 171, instead of the second communication holes 82.

Figure 8:
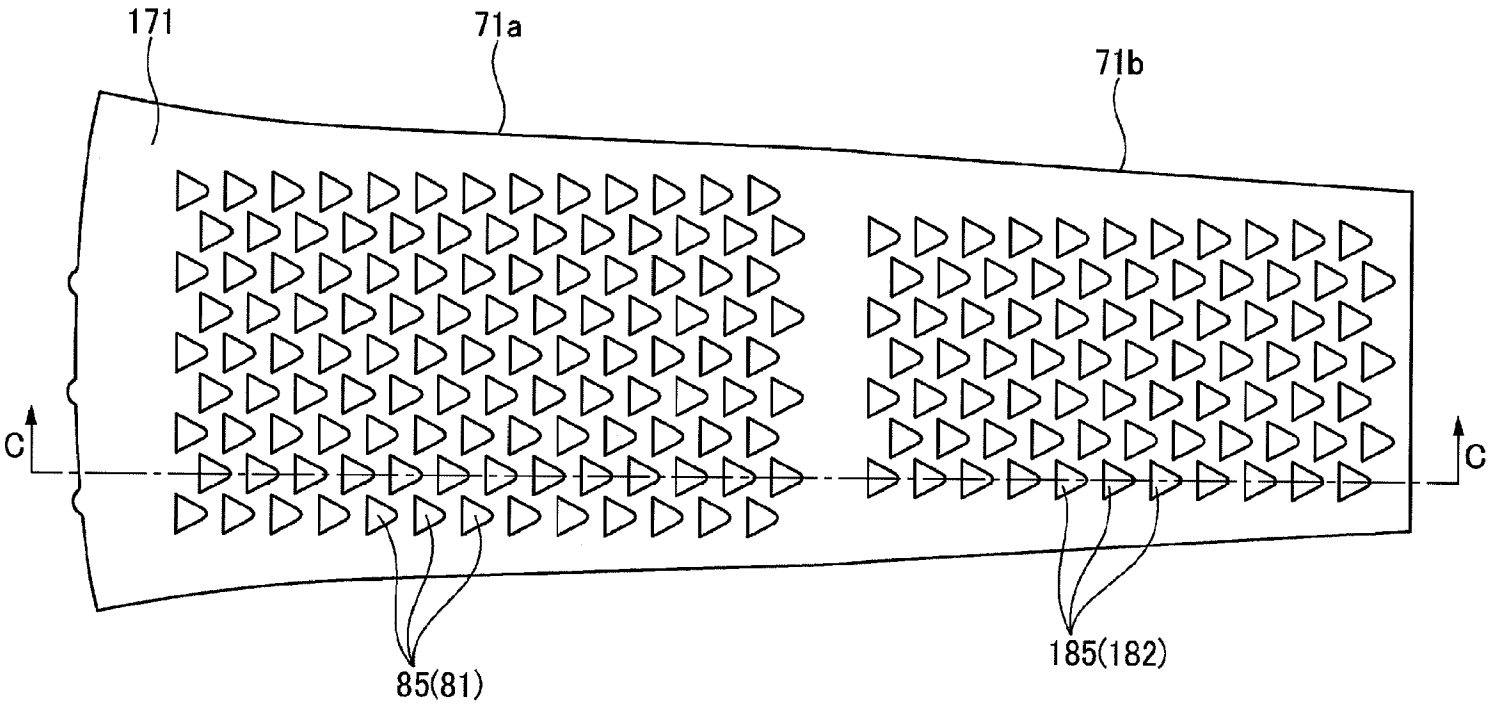
FIG. 8 is a development diagram representing an inner cylinder part illustrated in FIG. 7.
Figure 9:
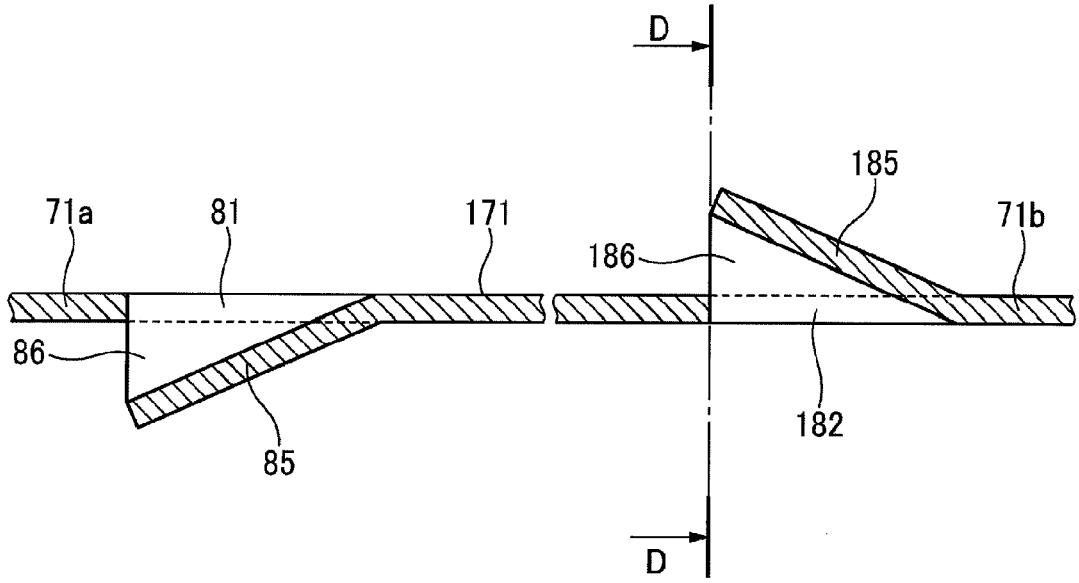
FIG. 9 is a cross-sectional view taken along line C-C of FIG. 8.
Figure 10:
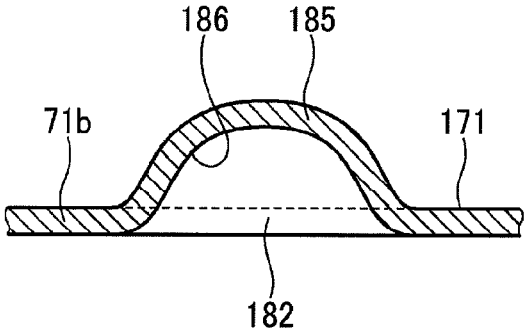
FIG. 10 is a cross-sectional view taken along line D-D of FIG. 9.

As illustrated in FIGS. 8 to 10, the second communication hole 182 has the same shape as that of the first communication hole 81, and is formed into a triangle and a top point thereof is disposed so as to face the downstream side of the exhaust when viewed from a radial direction of the inner cylinder part 171. Further, the second communication hole 182 includes guide walls 185 extending toward the outside of the inner cylinder part 171 and inlet openings 186 formed by the guide walls 185 and opened toward an upstream side of the exhaust. The guide wall 185 is formed into a shape like a cone shape vertically cut in half. Accordingly, the inlet opening 186 forms a semicircular opening. Further, the plurality of second communication holes 182 is disposed in a zigzag shape so that the inlet opening 186 on an upstream side and the inlet opening 186 on a downstream side do not overlap along the flow of the exhaust.

Further, the inner cylinder part 171 is formed by rolling up and forming a metal plate with the plurality of first communication holes 81 and the plurality of second communication holes 182 press molded, into a cylinder shape so that the guide wall 85 of the first communication hole 81 becomes the inner side. Further, the inner cylinder part 171 is formed so that a diameter thereof decreases along the downstream side of the exhaust.

Further, in the present modified example, the plurality of first communication holes 81 and the plurality of second communication holes 182 are formed on an upstream side of the inner cylinder part 171 rather than a downstream end thereof. Further, a partition plate 76 is provided on an outer peripheral surface of the downstream end of the inner cylinder part 171, and the first and second noise absorbing materials 91 and 92 are positioned by the partition plate 76.

As described above, according to the present modified example, since the second communication holes 182 include the guide walls 185 extending toward the outside of the inner cylinder part 171 and the inlet openings 186 formed by the guide walls 185 and opened toward the upstream side of the exhaust, the pressure wave of the exhaust gas introduced to the outside of the inner cylinder part 171 can be positively returned inside the inner cylinder part 171. Thus, the muffling effect by the noise absorbing materials 91 and 92 can be further improved.

Further, according to the present modified example, since the plurality of first communication holes 81 and the plurality of second communication holes 182 are formed on the upstream side of the inner cylinder part 171 rather than the downstream end thereof, the long tail pipe 74 on the downstream side of the inner cylinder part 171 can remain without increasing a size of the muffler 62. Accordingly, exhaust inertia becomes good, so that the muffling effect can be improved while improving engine performance.

Further, according to the present modified example, since the partition plate 76 is provided on the outer peripheral surface of the downstream end of the inner cylinder part 171 and the first and second noise absorbing materials 91 and 92 are positioned by the partition plate 76, movement of the noise absorbing materials 91 and 92 by the exhaust gas introduced to the outside of the inner cylinder part 171 can be prevented. Thus, the muffling effect can be improved for a long time.

Figure 11:
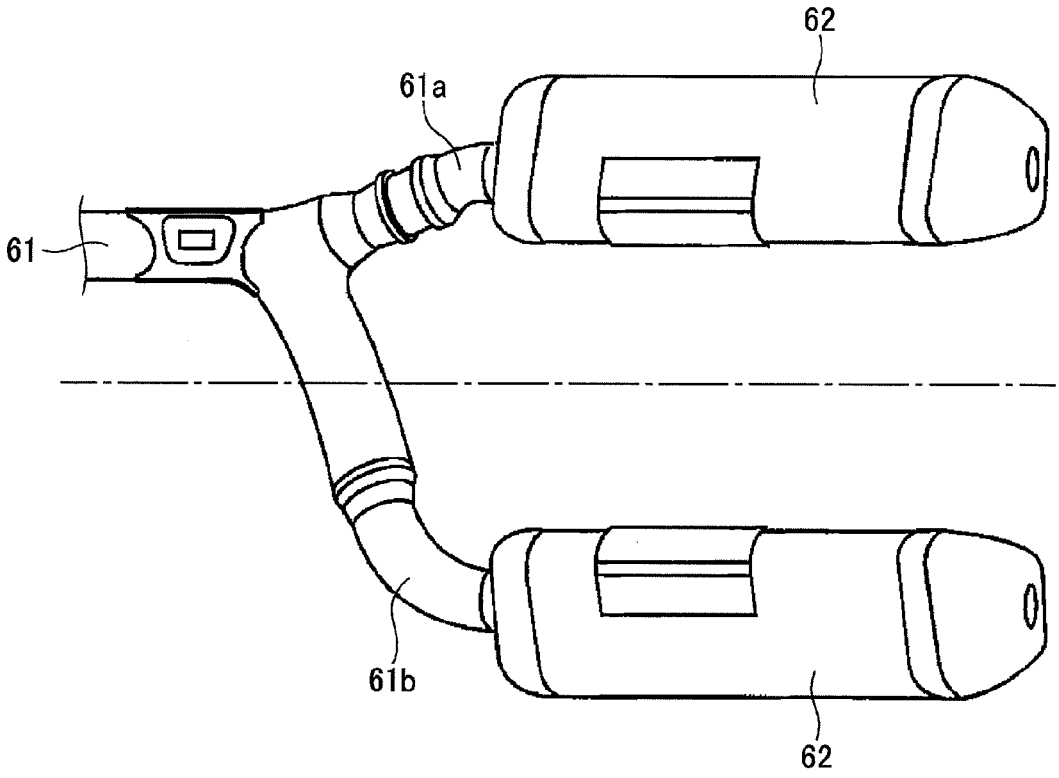
FIG. 11 is a top view describing a modified example of an exhaust system.

Further, the present invention is not limited to the exemplified embodiment, and may be appropriately changed without departing from a spirit of the present invention. For example, in the embodiment, the present invention is applied to a type of the exhaust system including one muffler, but is not limited thereto and may be applied to a type of the exhaust system including two mufflers. Particularly, for example, as illustrated in FIG. 11, a downstream side portion of the exhaust pipe 61 is branched into two portions in a vehicle width direction and the muffler 62 is attached to each of the downstream ends of the two branched exhaust pipes 61*a* and 61*b*.

Then, in this case, since the number of mufflers 62 is two, the exhaust gas flowing through a more central portion of the inner cylinder part 71 (171) can be introduced while decreasing a guide height, and productivity of the inner cylinder part 71 (171) can be improved while improving the muffling effect.

Hereinafter, an exhaust noise measurement test performed in order to confirm a function effect of the exhaust system of the engine of the present invention (the embodiment of the present invention) will be described.

In the present test, the muffler which is the embodiment of the present invention represented in FIG. 3 and a muffler of a comparative example were prepared, a throttle of each muffler was rapidly opened from an idling state, and a revolution limit state was maintained for one to two seconds, to measure exhaust noise until the closing of the throttle. The measurement was based on an assumption that revolution of the engine was cut by the sudden decrease in loads of the driving wheels due to a jump, and the like, in a case of a racing vehicle used for a race, and the like, in which a frequency of the driving with high-power output is high. A result is represented in FIG. 12.

The muffler of the comparative example has the same basic structure as that of the muffler illustrated in FIG. 3, an inner cylinder part thereof is formed into a straight shape, and communication holes having the same circular shape as those of the second communication holes are disposed in a zigzag shape in an entire surface of the inner cylinder part. Accordingly, the first communication hole is not formed in the inner cylinder part. Further, no first and third noise absorbing materials made of a steel wool are provided. Only noise absorbing material made of a glass wool is filled inside an annular chamber of the muffler. Further, the third communication hole is not formed in an exhaust pipe.

Figure 12:
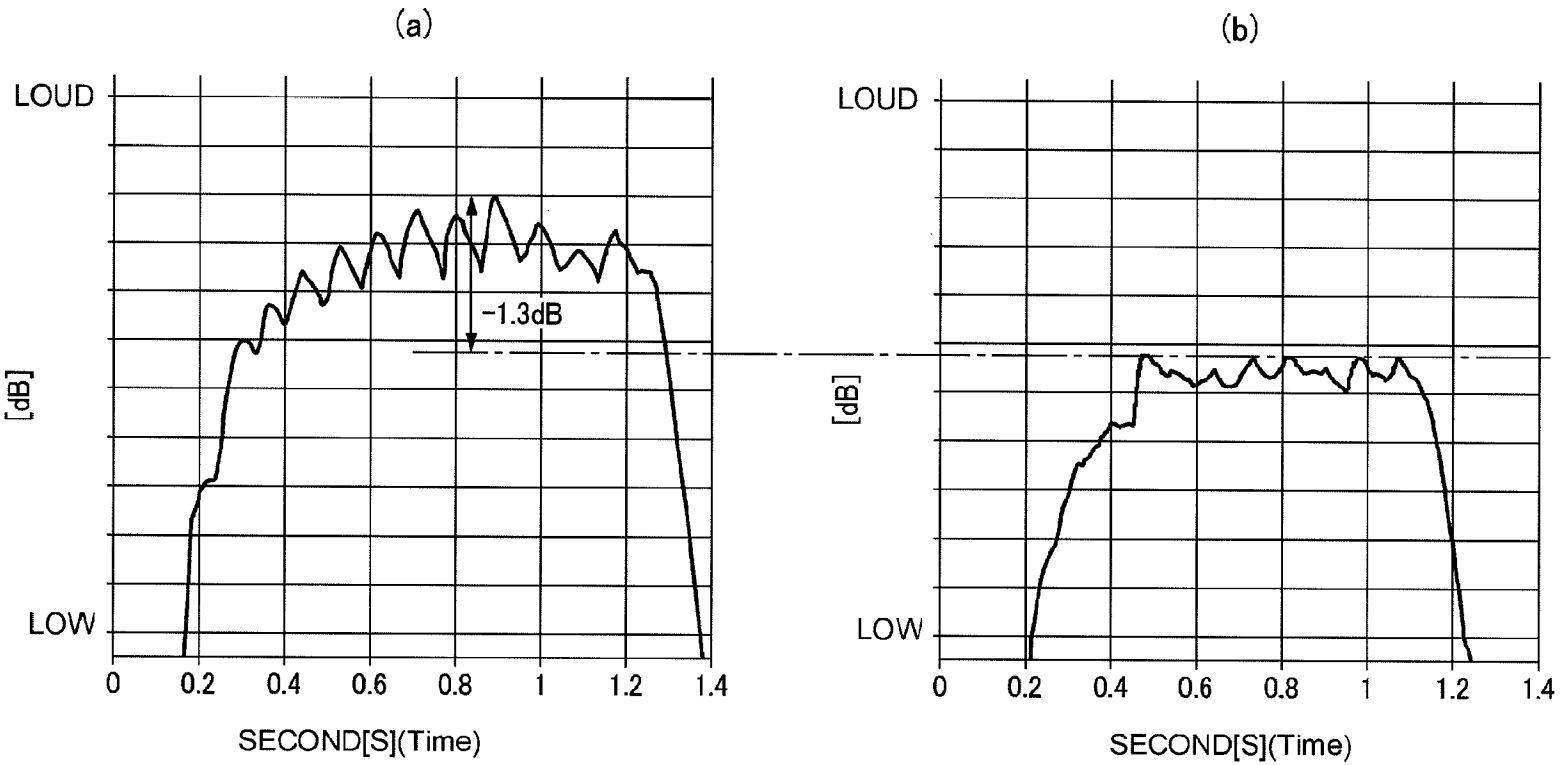
FIGS. 12(*a*) and 12(*b*) are graphs illustrating a muffling effect under a predetermined measurement condition, in which 12(*a*) is a graph illustrating a muffling effect of a muffler of a comparative example and 12(*b*) is a graph illustrating a muffling effect of a muffler of an embodiment of the present invention.

As clearly illustrated in FIG. 12, the exhaust noise of the muffler of the embodiment of the present invention is decreased by 1.3 dB compared to the exhaust noise of the muffler of the comparative example.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims

What is claimed is:

1. An exhaust system for an engine comprising:

an exhaust pipe connected to an exhaust port of the engine; and a muffler attached to a downstream end of the exhaust pipe and configured to reduce exhaust noise;

said muffler including an inner cylinder part connected to the downstream end of the exhaust pipe, an outer cylinder part configured to cover an outside of the inner cylinder part, and noise absorbing material disposed between the inner cylinder part and the outer cylinder part;

a plurality of first communication holes providing communication between an inside and the outside of the inner cylinder part, said plurality of first communication holes being formed in an upstream portion of the inner cylinder part; and a plurality of second communication holes providing communication between the inside and the outside of the inner cylinder part, said plurality of second communication holes being formed in a downstream portion of the inner cylinder part;

wherein the plurality of first communication holes includes a guide wall extending toward the inside of the inner cylinder part and an inlet opening formed by the guide wall and opened toward an upstream side of exhaust, wherein the plurality of second communication holes includes a guide wall extending toward the outside of the inner cylinder part and an inlet opening formed by the guide wall and opened toward the upstream side of the exhaust, and wherein the plurality of first communication holes and the plurality of second communication holes are formed on the upstream side of the inner cylinder part rather than the downstream end thereof.

2. The exhaust system for the engine according to claim 1, wherein the inner cylinder part is formed wherein a diameter thereof decreases along a downstream side of the exhaust.

3. The exhaust system for the engine according to claim 1, wherein the plurality of first communication holes and the plurality of second communication holes are formed by press molding a metal plate; and the inner cylinder part is formed by rolling up and forming the metal plate into a cylinder shape wherein the guide wall of each first communication hole becomes an inner side.

4. The exhaust system for the engine according to claim 2, wherein the plurality of first communication holes and the plurality of second communication holes are formed by press molding a metal plate; and the inner cylinder part is formed by rolling up and forming the metal plate into a cylinder shape so that the guide wall of each first communication hole becomes an inner side.

5. The exhaust system for the engine according to claim 1, wherein the noise absorbing material includes a first noise absorbing material configured to cover an outer peripheral surface of the inner cylinder part, and a second noise absorbing material configured to cover an outer peripheral surface of the first noise absorbing material; and the first noise absorbing material has higher heat resistance than that of the second noise absorbing material.

6. The exhaust system for the engine according to claim 2, wherein the noise absorbing material includes a first noise absorbing material configured to cover an outer peripheral surface of the inner cylinder part, and a second noise absorbing material configured to cover an outer peripheral surface of the first noise absorbing material; and the first noise absorbing material has higher heat resistance than that of the second noise absorbing material.

7. The exhaust system for the engine according to claim 2, wherein the plurality of first communication holes and the plurality of second communication holes are formed by press molding the metal plate;

the inner cylinder part is formed by rolling up and forming the metal plate into the cylinder shape so that the guide wall of the first communication hole becomes the inner side;

the noise absorbing material includes the first noise absorbing material configured to cover the outer peripheral surface of the inner cylinder part, and the second noise absorbing material configured to cover the outer peripheral surface of the first noise absorbing material; and the first noise absorbing material has higher heat resistance than that of the second noise absorbing material.

8. The exhaust system for the engine according to claim 7, wherein a third communication hole having a larger opening area than that of the second communication holes is further formed in a portion of the exhaust pipe upstream from the inner cylinder part; and an outer peripheral surface of the exhaust pipe at a position with the third communication hole formed is covered by a third noise absorbing material.

9. The exhaust system for the engine according to claim 2, wherein the plurality of first communication holes is disposed in a zigzag shape so that the inlet opening of each first communication hole on an upstream side and the inlet opening of each first communication hole on a downstream side do not overlap along a flow of the exhaust.

10. The exhaust system for the engine according to claim 1, wherein a downstream side portion of the exhaust pipe is branched into two portions and the muffler is attached to each of downstream ends of two branched exhaust pipes.

11. The exhaust system for the engine according to claim 1, wherein a partition plate is provided on an outer peripheral surface at a downstream end of the inner cylinder part, and the noise absorbing materials are positioned by the partition plate.

12. An exhaust system for use with an engine comprising:

a muffler including an inner cylinder part adapted to be connected to a downstream end of an exhaust pipe, an outer cylinder part configured to cover an outside of the inner cylinder part, and noise absorbing material disposed between the inner cylinder part and the outer cylinder part;

a plurality of first communication holes providing communication between an inside and the outside of the inner cylinder part, said plurality of first communication holes being formed in an upstream portion of the inner cylinder part; and a plurality of second communication holes providing communication between the inside and the outside of the inner cylinder part, said plurality of second communication holes being formed in a downstream portion of the inner cylinder part;

wherein the plurality of first communication holes includes a guide wall extending toward the inside of the inner cylinder part and an inlet opening formed by the guide wall and opened toward an upstream side of exhaust, wherein the plurality of second communication holes includes a guide wall extending toward the outside of the inner cylinder part and an inlet opening formed by the guide wall and opened toward the upstream side of the exhaust, and wherein the plurality of first communication holes and the plurality of second communication holes are formed on the upstream side of the inner cylinder part rather than the downstream end thereof.

13. The exhaust system for use with the engine according to claim 12, wherein the inner cylinder part is formed wherein a diameter thereof decreases along a downstream side of the exhaust.

14. The exhaust system for use with the engine according to claim 12, wherein the plurality of first communication holes and the plurality of second communication holes are formed by press molding a metal plate; and the inner cylinder part is formed by rolling up and forming the metal plate into a cylinder shape wherein the guide wall of each first communication hole becomes an inner side.

15. The exhaust system for use with the engine according to claim 12, wherein the noise absorbing material includes a first noise absorbing material configured to cover an outer peripheral surface of the inner cylinder part, and a second noise absorbing material configured to cover an outer peripheral surface of the first noise absorbing material; and the first noise absorbing material has higher heat resistance than that of the second noise absorbing material.

16. The exhaust system for use with the engine according to claim 13, wherein the plurality of first communication holes and the plurality of second communication holes are formed by press molding the metal plate;

the inner cylinder part is formed by rolling up and forming the metal plate into the cylinder shape so that the guide wall of the first communication hole becomes the inner side;

the noise absorbing material includes the first noise absorbing material configured to cover the outer peripheral surface of the inner cylinder part, and the second noise absorbing material configured to cover the outer peripheral surface of the first noise absorbing material; and the first noise absorbing material has higher heat resistance than that of the second noise absorbing material.

17. The exhaust system for use with the engine according to claim 16, wherein a third communication hole having a larger opening area than that of the second communication holes is further formed in a portion of the exhaust pipe upstream from the inner cylinder part; and an outer peripheral surface of the exhaust pipe at a position with the third communication hole formed is covered by a third noise absorbing material.

* * * * *